US006862848B1

(12) United States Patent
Lang et al.

(10) Patent No.: US 6,862,848 B1
(45) Date of Patent: Mar. 8, 2005

(54) METHOD AND APPARATUS FOR REDUCING EARTHQUAKE DAMAGE IN DEVELOPING NATIONS USING RECYCLED TIRES

(76) Inventors: Anna F Lang, 12 San Marino Dr., San Rafael, CA (US) 94901; Jeffrey D Sargent, 3146 Oak Rd., Walnut Creek, CA (US) 94596

( * ) Notice: Subject to any disclaimer, the term of this patent is extended or adjusted under 35 U.S.C. 154(b) by 57 days.

(21) Appl. No.: 10/200,938

(22) Filed: Jul. 22, 2002

(51) Int. Cl.[7] ..... E04B 1/98

(52) U.S. Cl. ..... 52/167.1; 52/167.8; 52/169.9; 52/DIG. 9; 52/167.6

(58) Field of Search ..... 52/167.1, 167.6, 52/167.8, 167.9, 167.5, DIG. 9, 299, 169.9; 405/229, 231, 244, 250, 251, 288, 300; 248/351

(56) References Cited

U.S. PATENT DOCUMENTS 5,143,484 A * 9/1992 Deul ..... 405/288
5,172,528 A * 12/1992 Clarke ..... 52/198
5,645,371 A * 7/1997 Marzullo ..... 405/33
6,085,474 A * 7/2000 Mizuno ..... 52/167.5
6,457,912 B1 * 10/2002 Leibl ..... 405/302.4
6,533,501 B1 * 3/2003 Callinan et al. ..... 405/229

* cited by examiner

*Primary Examiner*—Brian E. Glessner
*Assistant Examiner*—Chi Q. Nguyen
(74) *Attorney, Agent, or Firm*—Gary Hoenig

(57) ABSTRACT

This invention provides an inexpensive and plausible means of earthquake protection for personal residences in developing nations and economically distressed areas within the United States through the use of recycled tires containing a particular rock aggregate.

18 Claims, 5 Drawing Sheets

METHOD AND APPARATUS FOR REDUCING EARTHQUAKE DAMAGE IN DEVELOPING NATIONS USING RECYCLED TIRES

This invention provides an inexpensive and plausible means of earthquake protection for personal residences in developing nations and economically distressed areas within the United States through the use of recycled tires containing a particular rock aggregate.

BACKGROUND OF THE INVENTION

Modern and deliberate design practices which mitigate damage from earthquakes are well known to structural engineers practicing the art. The implementation of such design practices requires engineering study of building structures, of postulated earthquake response spectra, and of soil conditions. Such design practices are typically not amenable to economically distressed areas. As a consequence, earthquakes in economically distressed areas account for a disproportionate loss of life, principally due to inadequate construction of habitable structures. This is especially true for personal residences. There is a need for a low-cost solution to the tremendous losses of life and property given earthquakes in economically distressed areas.

The concept is known that used tires filled with some material, when used for base insolation of structures, may reduce acceleration loads caused by earthquakes. No physical demonstration of this concept is known. No recommendation, published or otherwise, of an appropriate fill material is known.

SUMMARY OF THE INVENTION

This invention presents a method and apparatus of using automotive tires filled with "¾ inch rock aggregate" (defined below) to reduce ground motion accelerations experienced by habitable structures given an earthquake. The direct application of this invention is intended for residential structures in developing nations and economically distressed areas within the United States. Application of this invention provides a low or no-cost solution to the tremendous losses of life and property given earthquakes. This invention teaches that application of the proper tire/aggregate system provides an effective means of reducing seismic loads imposed on structures through absorption of such loads through frictional dissipation by the aggregate contained within the tire.

This invention has been reduced to practice, demonstrating that upwards of 85% of applied accelerations may be successfully absorbed by application of its preferred embodiment.

An objective of this invention is to save lives within marginally designed residential areas in the event of an earthquake.

A further objective of this invention is to employ readily available materials.

A further objective of this invention is to use simple methods of construction and application.

A further objective of this invention is to minimize non-structural damage associated with habitable structures such as windows, building ornaments and similar objects.

DESCRIPTION OF THE PREFERRED EMBODIMENT

Development of the Preferred Embodiment

Development of this invention necessitated physical testing in a seismic laboratory. A recycled tire was placed in a horizontal position on a shake table and filled with soil, sand or rock aggregate. An axial load was then placed on top of the tire, the system then subjected to vibrations. Acceleration measurements were taken above and below the tire: at the point the axial load was applied above the tire surface (termed "Plate" in FIG. 1), and at top of the shake table (i.e., below the tire). Different fill materials were selected for their ready availability and low cost, both in the United States and in developing nations. For each tire/fill system, two tests were performed having different axial loads. The two axial loads correspond to different configurations of tires beneath a structure; if there are fewer tires supporting a building, each tire will bear more weight. Physical loading, simulating a structure, was either 2,700 or 4,800 pounds, herein termed light and heavy axial loads. These weights eliminate the typical weight of a personal residence which might be supported by one or more tires; that is, multiple tires may be employed depending on the total weight of the structure such that each tire may bear approximately 2,700 pounds/tire, or approximately 4,800 pounds/tire axial loading.

Each test subjected the tire/fill system to a wide range of frequencies, from 1.0 to 5.0 Hz. The tests were incremented by 0.2 ΔHz, decreasing to 0.1 ΔHz when about the system's natural frequency. Results included acceleration, transmissibility and force-displacement plots.

Figure 1:
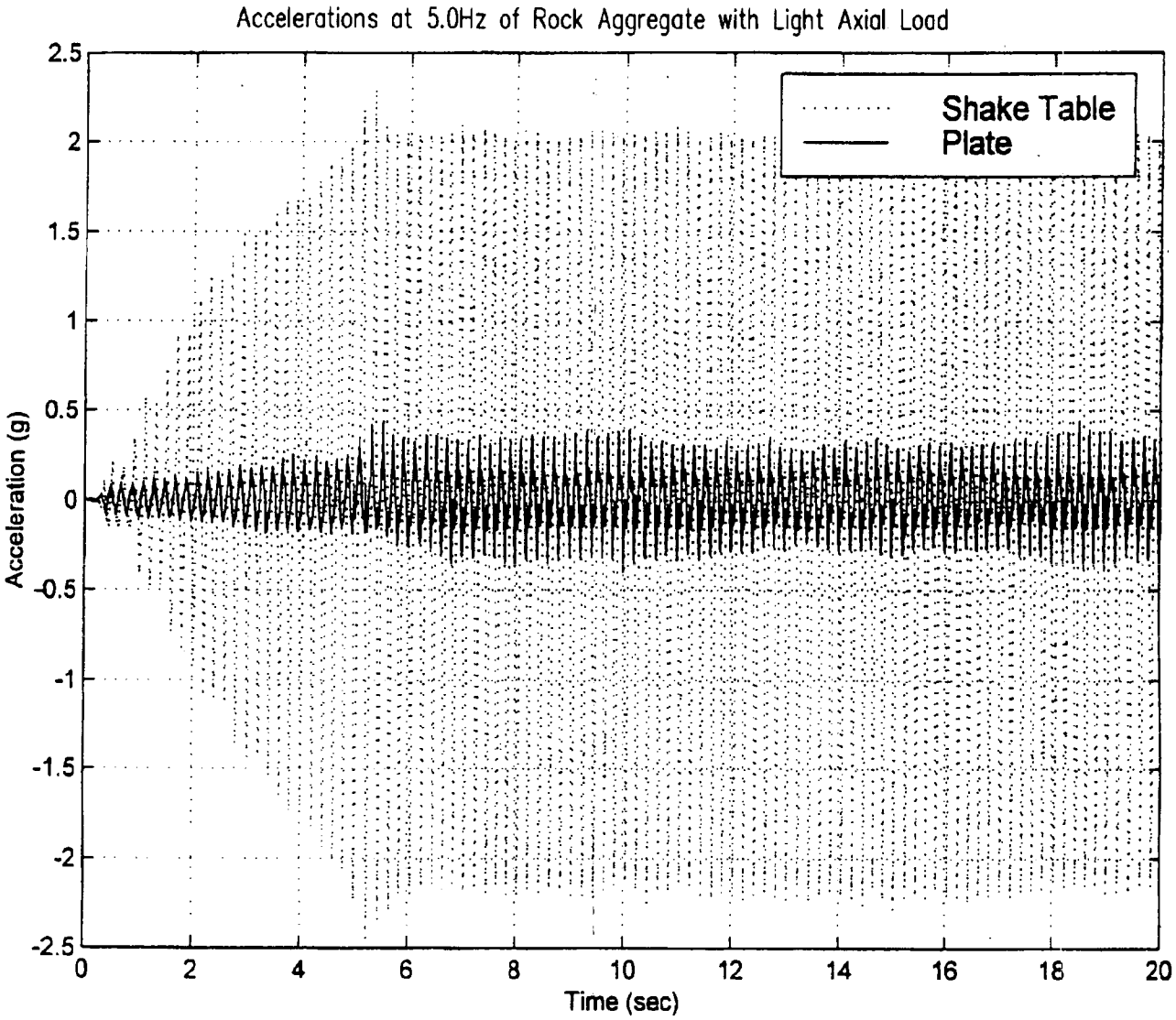
FIG. 1 is an acceleration plot associated with a tire/aggregate system using ¾ inch rock aggregate bearing a light axial load demonstrating a reduction in acceleration transmitted from the ground (i.e., termed the "Shake Table" in FIG. 1) to the structure (i.e., termed the "Plate" in FIG. 1).

Two acceleration plots were produced for each test: one at the estimated natural frequency and the other demonstrating the tire/fill system's ability to reduce (or not) the acceleration of the load. The acceleration plot taken at the system's natural frequency may demonstrate a slight amplification of accelerations. FIG. 1 is an acceleration plot obtained for this invention's preferred embodiment, using a fill material of ¾ inch rock aggregate consisting of crushed granite, and bearing a light axial load; more fully discussed below. As seen in FIG. 1 accelerations were reduced by approximately 85%.

With slight discrepancies, the ¾ inch rock aggregate behaved similarly for both the light and heavy axial loads. Typically at frequencies above 2 Hz both test configurations using rock aggregate performed remarkably well: the eliminated structure's accelerations (the "Plate" of FIG. 1) were typically reduced 3 to 6 times relative to shake table accelerations. However, in general accelerations were better reduced when the rock aggregate was configured for the light axial load. For this configuration, as observed in FIG. 1, accelerations were reduced by a factor of approximately 8 at 5.0 Hz. For the heavy axial load configuration accelerations were reduced by a factor of 4 at 4.8 Hz.

Transmissibility

Transmissibility is herein defined as the ratio of the maximum transmitted force to the maximum applied force, $TR=F_{T\text{-}max}/F_o$. This is also equivalent to a ratio of corresponding accelerations. Transmissibility plots are used to determine the effectiveness of a base-isolator by observing reduction and amplification ranges, and the natural period of the system. A transmissibility value greater than 1.0 indicates an amplification of motion experienced by the load. The natural period corresponds to the largest transmissibility value. Base-isolators are generically intended to lower the natural frequency of a structure below that of anticipated ground motions, thus reducing the structure's response during seismic action. When practicing this invention it is important to understand that the apparent natural frequency of the combined tire/fill system and structure is reduced. For this reason, it is important to know within what period range any amplification might occur. Indeed, this may only be understood through seismic testing of unique materials.

Figure 2:
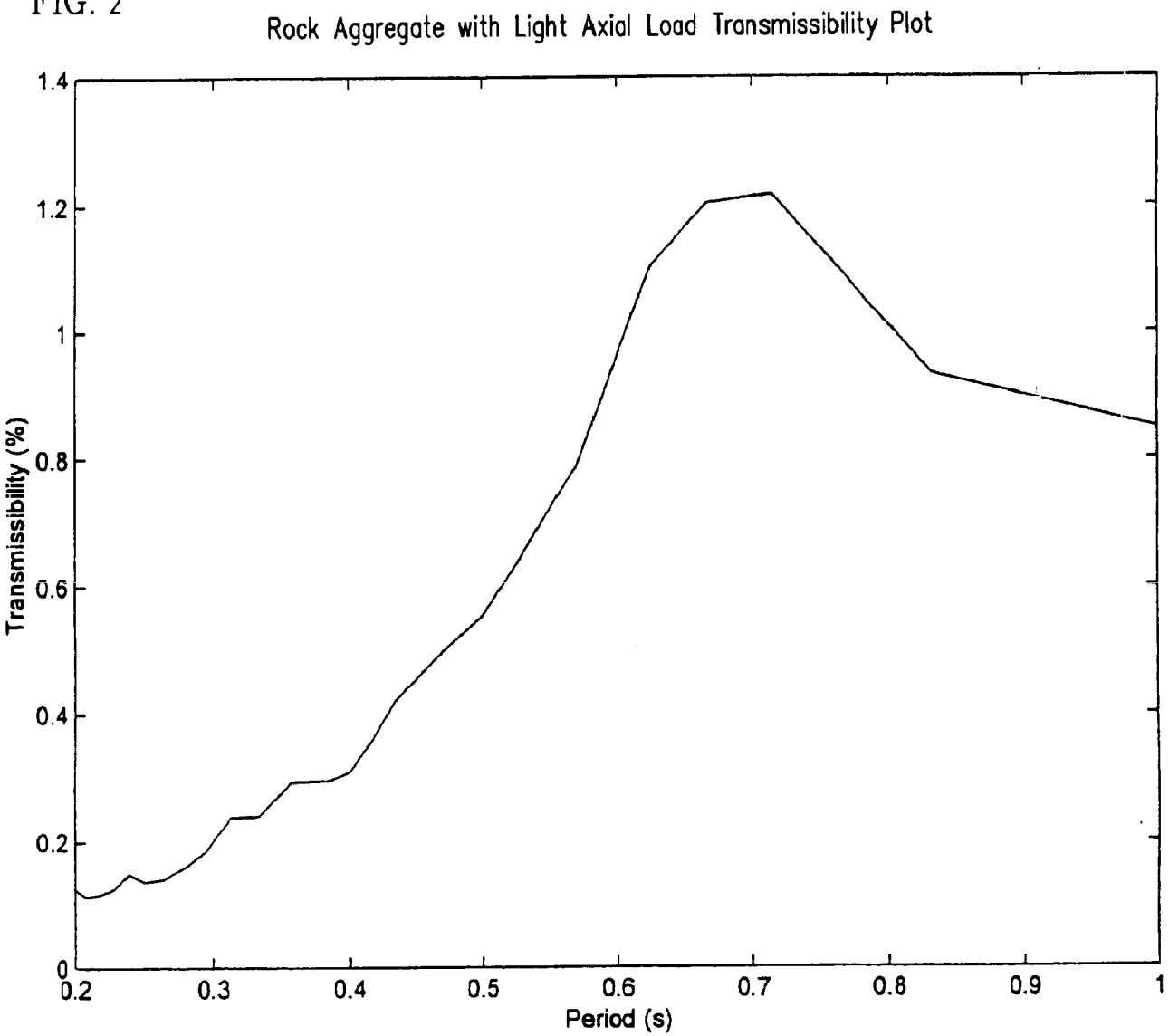
FIG. 2 is a transmissibility plot demonstrating the spectra transmission of accelerations for the tire/aggregate system bearing a light axial load (defined below).
Figure 3:
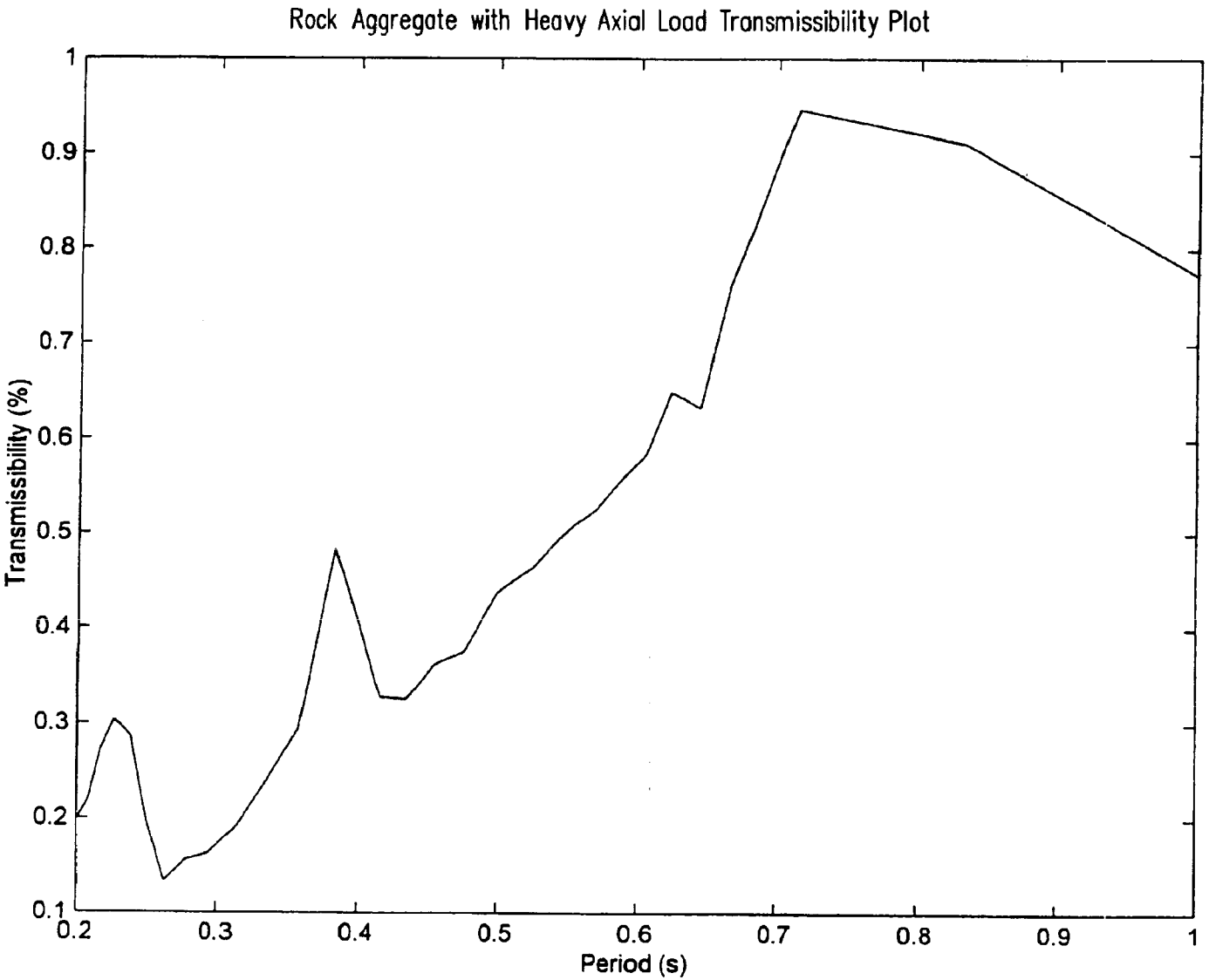
FIG. 3 is a transmissibility plot demonstrating the spectra transmission of accelerations for the tire/aggregate system bearing a heavy axial load (defined below).

FIGS. 2 and 3 show transmissibility versus period plots for two aggregate tests. As seen in TABLE 1, light and heavy axial loading tests reveal that natural periods do not significantly change as the weight is increased. As applied to this invention this means that rigid qualifications on loadings, given a particular aggregate fill, are not required. This suggests that based on the equation: $\omega=\sqrt{(k/m)}$, as the natural period ($\omega$) remains constant, the mass (m) and stiffness coefficient (k) increase proportionally. This finding has been used to establish a range of loadings applicable for the preferred embodiment. FIGS. 2 and 3, employing aggregate, demonstrate this relationship. Of significance to this invention is that the stiffness of a tire/fill system, and as exclusively found when using a rock aggregate fill, is proportional to the structure's loading. TABLE 1 also demonstrates that use of soil fill is dangerous given its variable natural period using the same axial load. Some variability was observed when using sand, when comparing the light versus heavy load natural periods.

TABLE 1

| | Measured Natural Periods ($\omega$) | | | |
|---|---|---|---|---|
| Tire Fill | Soil | Sand | 3/4 in. Rock | 3/4 in. Rock |
| Load | Light Axial Load | Light Axial Load | Light Axial Load | Heavy Axial Load |
| Period (sec) | 0.4 to 0.6 | 0.55 | 0.69 | 0.71 |

The typical single-story personal residence has a natural period between 0.1 and 0.5 seconds. The work developing this invention indicates through its transmissibility plots that, conservatively, within the range of 0.2 to 0.5 seconds, the light axial loading situation has an average transmissibility of 20% while the heavy axial load case has an average transmissibility of approximately 30%. Although both light and heavy axial load cases performed well (and the heavy case has a lower minimum transmissibility), the light axial load case represents the preferred embodiment over this important range of natural periods given its consistency as observed in FIG. 2.

The successful performance of the rock aggregate is credited to its relatively large particle size, and that it has a relatively high surface to volume ratio given that crushed rock was used. Because of this, more friction is developed, and therefore more energy is dissipated. The energy absorbed through friction reduces the accelerations that the structure experiences. Because displacements are related to accelerations, motion of the structure is significantly reduced resulting in less structural damage.

Force-Displacement

Figure 4:
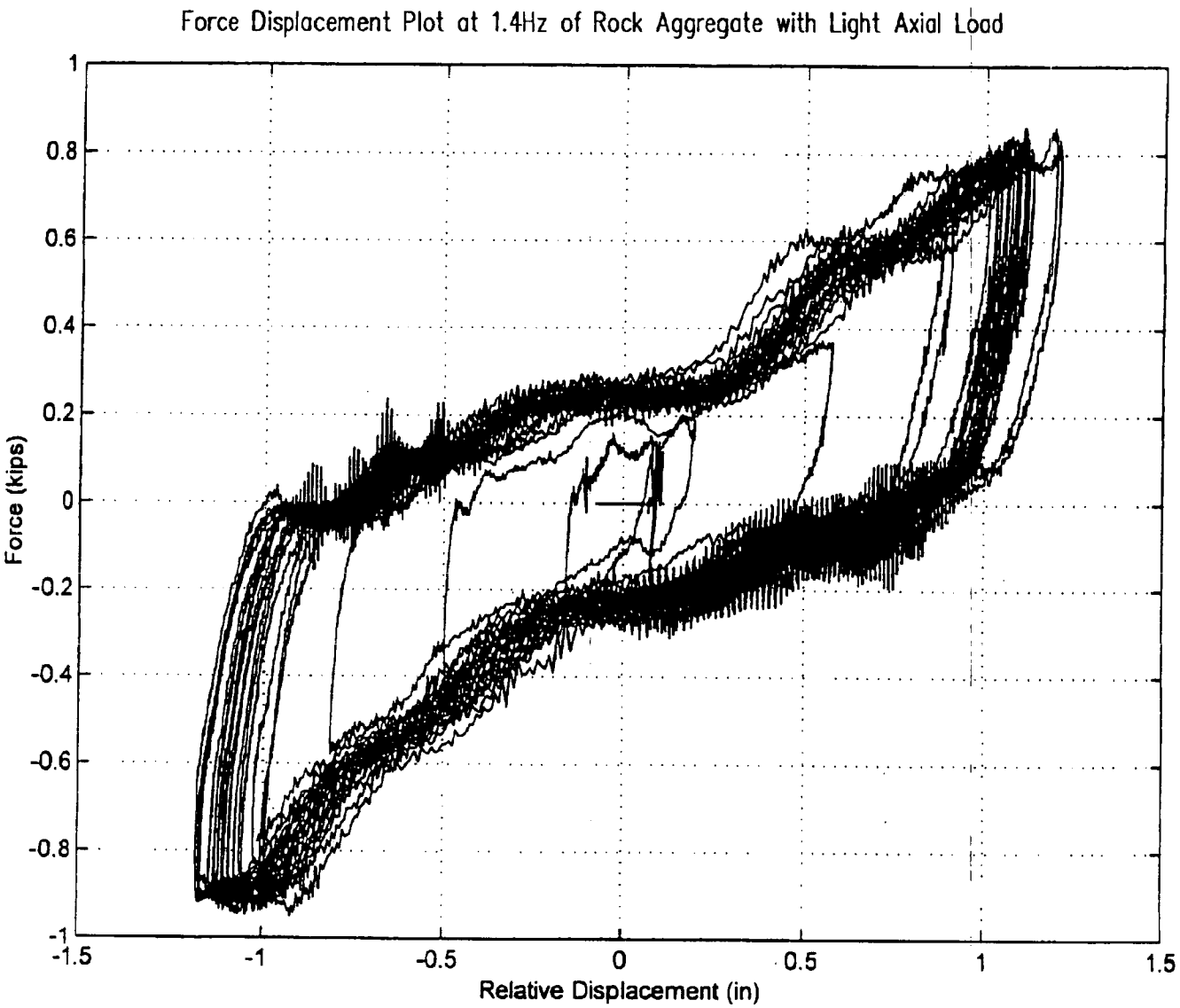
FIG. 4 is a force-displacement plot demonstrating the energy absorption capabilities of the tire/aggregate system with a light axial load when subjected to a frequency of 1.4 Hz.

Along with acceleration and transmissibility plots, the development of force-displacement plots for his invention allowed determination of the efficiency of various tire/fill systems leading to the preferred embodiment. From the shape and consistency of hysteresis loops, it may be determined whether the system is effective at dissipating energy, and if the system would break down over the course of cyclic loading. Refer to FIG. 4 for a force-displacement plot using the preferred embodiment. Also, such plots were used to determine an approximate stiffness for each system. The stiffness coefficient may be used in calculating a theoretical natural period to be compared to the experimental natural period. Such comparison was done to check the data's validity. To produce the force-displacement plots, the accelerations from both the mass above the tire and the shake table below were integrated twice to obtain displacements. Subtracting the two displacements yields relative displacement of the tire. This value was then plotted against the force calculated from the mass and shake table accelerations, F=ma, for any given time.

To produce the force-displacement plots, the shake table ran continuously for approximately 10 minutes but wherein its period was changed every 20 seconds. This facilitated plotting force versus displacement at varying frequencies with 20 seconds of data for each plot This method produced detailed hysteresis loops as seen in FIG. 4 demonstrating results from ¾ inch rock aggregate tested with light axial loads at 1.4 Hz. The consistent loop shape demonstrates that the ¾ inch rock aggregate within the tire does not break down, indicative of the system's consistency during an earthquake. Thus, the same amount of energy dissipation may be expected throughout a cyclic loading because the aggregate does not degrade, and a recycled tire (used for these tests) with ¾ inch rock aggregate would not have to be replaced after a seismic event.

The area within a hysteresis loop is equivalent to the amount of energy absorbed by the isolating system. By comparing such data the preferred configuration was established; that is, a hysteresis loop with least area and one which demonstrates a consistent shape. Because friction force is directly proportional to normal force, the friction force is higher for the heavier tests. Thus the amount of energy necessary to resist the friction force is higher. Although a complex interaction of the rock and its frictional dissipation mechanisms is involved, force-displacement plots demonstrating hysteresis shapes allow for clear conclusions. Based on these analysis procedures, engineering judgement influenced by the testing experience, study of natural periods versus loads and other work developing this invention, the preferred embodiment is a configuration involving ¾ inch rock aggregate bearing a light axial load having a range from 2,000 to 3,400 pounds/tire.

Another reason for plotting force versus displacement is to obtain the stiffness of each test configuration using the secant method. This method draws a line from the origin of the force-displacement plot to the point of maximum force and displacement. The slope of this line is the approximate stiffness coefficient of the system. TABLE 2 lists the calculated stiffness coefficient for four fill materials tested and their axial loads. Note that constant and non-zero stiffnesses are missing with soil and sand, a potentially dangerous situation. Proportionality is noted with the rock aggregate, and believed to be only enhanced by rock surfaces which are rough, fractured or broken, and by hard rock (granite was used for testing); in any case smooth rock is clearly not preferred. For undeveloped regions, if conforming ¾ inch rock is not available, hard fractured river rock would represent a reasonable equivalent.

TABLE 2

Frequency (f) and Stiffness Coefficient (k) of Selected Tests Determined from Seismic Testing

| | Tire Fill | | | | | | | |
|---|---|---|---|---|---|---|---|---|
| | Soil | | Sand | | ¾ in. Rock | | ¾ in. Rock | |
| | Load | | | | | | | |
| | Light Axial Load | | Light Axial Load | | Light Axial Load | | Heavy Axial Load | |
| Parameter | f | k | f | k | f | k | f | k |
| Test 1–4 | 1.75 | ≈0 | 1.8 | 2.18 | 1.4 | 0.75 | 1.5 | 1.04 |
| Test 5–8 | 3.40 | ≈0 | 2.9 | 1.55 | 2.6 | 0.83 | 2.0 | 1.00 |
| Test 9–12 | 4.20 | ≈0 | 4.0 | 1.56 | 3.4 | 0.80 | 3.0 | n/a |

SUMMARY

For the preferred embodiment, as based on the experiences gained when developing this invention, the tire/fill system should consist of a typical automobile tire filled with ¾ inch rock aggregate (whose specification is defined below). By a typical automobile tire is meant a tire associated with economy vehicles to sport utility vehicles. Hard rock, such as granite, is preferred. Such hard rock should also be broken, fractured or crushed (which is preferred), as it will improve the material's surface/volume ratio thus increasing its ability to absorb frictional energy. Further, for the preferred embodiment, the tire/aggregate system's axial loadings should range between 2,000 and 3,400 pounds/tire. This invention teaches that the tire/aggregate system could provide an effective means of reducing the tremendous losses of life and property in developing nations due to earthquakes.

Using soil as tire fill material is dangerous and is not preferred. Using sand as tire fill material may be dangerous and is not preferred. The use of soil and sand should be avoided even when mixed in small quantities with rock aggregate.

Although the present invention has been described in detail with regard to certain preferred embodiments thereof, other embodiments within the scope of the present invention are possible, and described in-part herein, without departing from the scope, spirit and general applicability of the invention. Accordingly, the general theme and scope of the appended claims should not be limited to the descriptions of the preferred embodiment disclosed herein.

THE DRAWING

FIG. 1 is an acceleration plot associated with a tire/aggregate system using ¾ inch rock aggregate bearing a light axial load demonstrating a reduction in acceleration transmitted to the structure. FIG. 1 is discussed in paragraphs 0017 and 0018. In FIG. 1 data described by "Shake Table" eliminates ground motion of an earthquake. In FIG. 1 data described by "Plate" is that associate with the axial load, that is, the load eliminating a structure.

FIG. 2 is a transmissibility plot associated with a tire/aggregate system using ¾ inch rock aggregate bearing a light axial load demonstrating the spectra transmission of accelerations to the structure. FIG. 2 is discussed in paragraph 0020.

FIG. 3 is a transmissibility plot associated with a tire/aggregate system using ¾ inch rock aggregate bearing a heavy axial load demonstrating the spectra transmission of accelerations to the structure. FIG. 3 is discussed in paragraph 0020.

FIG. 4 is a force-displacement plot demonstrating the energy absorption capabilities of the tire/aggregate system with a light axial load when subjected to a frequency of 1.4 Hz. FIG. 4 is discussed in paragraphs 0023 and 0024.

Figure 5:
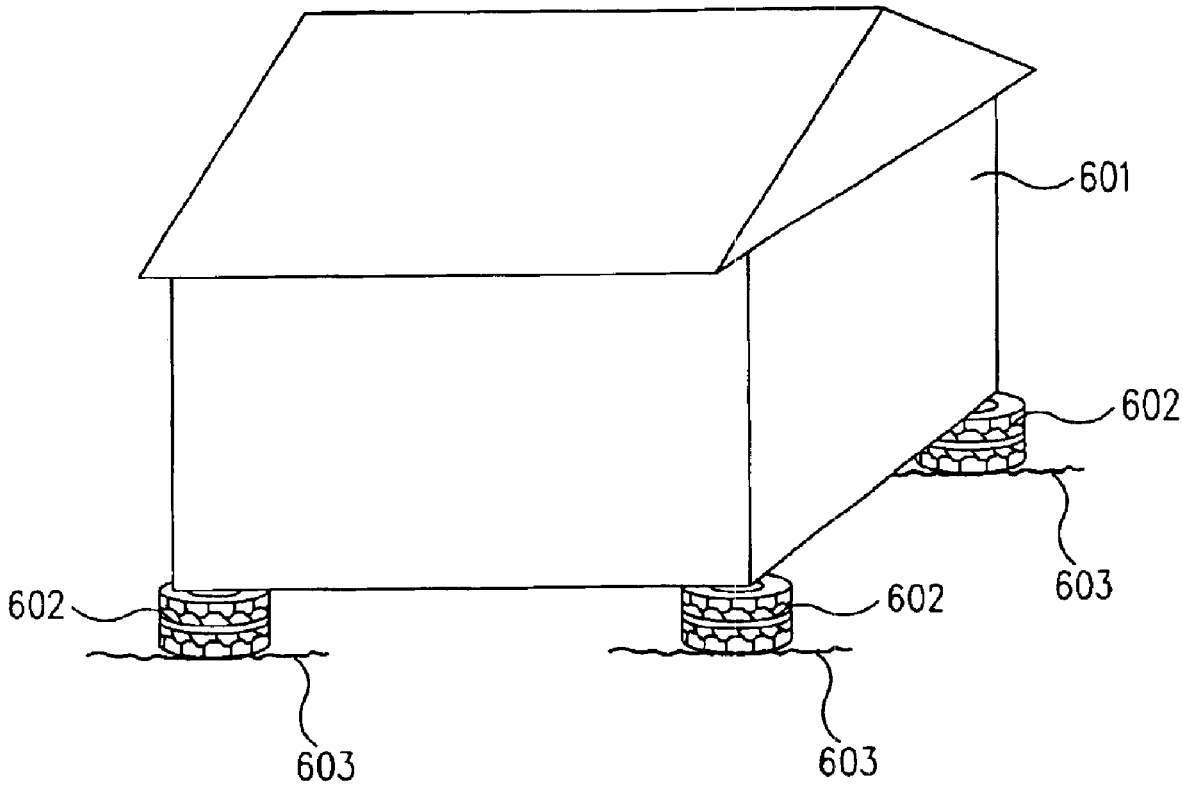
FIG. 5 is an apparatus drawing of the general configuration and typical application of this invention.

FIG. 5 is an apparatus drawing of the general configuration and typical application of this invention. 601 is a structure resting on tire/aggregate system 602 located at each corner of the structure 601. The tire/aggregate system 602 rests on unprepared earth 603, or may rest on prepared foundation material. The tire/aggregate system 602 is placed under the structure 601 such that individual axial loads are approximately 2,700 pounds/tire. It is assumed for the illustration of FIG. 5 that the structure 601 weights 10,800 pounds total, said weight being evenly distributed over four tire/aggregate systems located at each corner of 601. This need not be the case. If the weight of the structure is unevenly distributed, and/or has an irregular shape, then placement of each tire/aggregate system should be associated with the pattern of the structure's footprint, and in locations appropriate for the axial loadings of the tire/aggregate system. It is important that the majority of tire/aggregate systems be placed in such a manner as to accommodate, individually, the preferred axial loading range of 2,000 to 3,400 pounds/tire. Although it is considered acceptable to have a few axial loadings in a multiple tire situation fall below a minimum of 2,000 pounds/tire, such a situation is acceptable only provided that the majority of tire/aggregate systems bear individual axial loads within the preferred range. Further, it is not preferred, nor taught herein, that axial loadings exceed 3,400 pounds/tire. In other words, a situation involving multiple tire/aggregate systems whose averaged axial load might fall within the preferred range per tire, is not acceptable if any given tire/aggregate system bears over 3,400 pounds/tire, and is not acceptable if the majority of tire/aggregate systems do not lie within the preferred range.

For FIG. 1 and elsewhere herein, if used, the words "obtain", "obtained", "obtaining", "determine", "determined", "determining" or "determination" are defined as measuring, calculating, computing, assuming, estimating, processing or gathering from a data base. The words "establish", "established" or "establishing" are defined as measuring, calculating, computing, assuming, estimating, processing or gathering from a data base.

For FIG. 1 and elsewhere herein, the words "¾ inch rock aggregate" is defined as a hard rock, having a hardness similar to granite, which has been crushed or otherwise has been fractured resulting in numerous fractured surfaces, and which has passed through a sieve whose square open areas are ¾ inch on side. ¾ inch rock aggregate does not contain sand, fine gravel, nor fines from the crushing process. The phase "¾ inch rock aggregate" has common acceptance in the building trade industry, whose product, if a hard rock, is herein encompassed under the definition and use of "¾₁ inch rock regate". Further, test methods and material specifications related to ¾ inch rock aggregate may be found: in ASTM C136, "Standard Test Method for Sieve Analysis of Fine and Coarse Aggregates"; in ASTM D1139"Standard Specification Aggregate for Single or Multiple Bituminous Surface Treatments"; and in other applicable ASTM standards.

What is claimed is:

1. A method to protect a habitable structure and its occupants against earthquake damage, the method comprising the steps of:

obtaining a design of the habitable structure resulting in a footprint pattern, obtaining a total weight and distribution of weight of the habitable structure based on the design of the habitable structure and its footprint pattern, obtaining a set of automobile tires to be used to protect the habitable structure based on the total weight and distribution of weight, whose load bearing per tire lies between 2,000 and 3,400 pounds/tire, placing the set of automobile tires on the ground in locations-appropriate for the distribution of weight of the habitable structure and the load bearing per tire, obtaining a collection of ¾ inch rock aggregate adequate to fill the set of automobile tires, filling the set of automobile tires with the collection of ¾ inch rock aggregate, and placing the habitable structure on top of the set of automobile tires filled with the collection of ¾ inch rock aggregate.

2. The method of claim 1, wherein the step of obtaining the collection of ¾ inch rock aggregate, include the step of obtaining a collection of ¾ inch rock aggregate which is hard rock aggregate.

3. The method of claim 1, wherein the step of obtaining a collection of ¾ inch rock aggregate, includes the step of obtaining a collection of ¾ inch rock aggregate which is crushed granite rock.

4. The method of claim 2, wherein the step of obtaining a collection of ¾ inch rock aggregate which is hard rock aggregate, includes the step of obtaining a collection of ¾ inch rock aggregate which is crushed hard river rock.

5. The method of claim 1, wherein the step of obtaining the collection of ¾ inch rock aggregate, includes step of obtaining a collection of ¾ inch rock aggregate which is ¾ inch crushed rock aggregate.

6. The method of claim 1, wherein the step of obtaining a set of automobile tires to be used to protect the habitable structure, includes the step of obtaining a set of recycled automobile tires to be used to protect the habitable structure based on the total weight and distribution of weight, whose load bearing per tire lies between 2,000 and 3,400 pounds/tire.

7. A method for quantifying the selection of an automobile tire and its fill material as designed to protect a habitable structure and its occupants against earthquake damage, the method comprising the steps of:

selecting a set of automobile tires, each set consisting of the same size category of automobile tire, selecting a set of rock aggregate, each set consisting of the same size category, hardness category and general surface condition category of rock aggregate, selecting a set of axial loads, selecting a set of vibration spectra which will result in a collection of vibrations applied to the shake table, accessing a shake table apparatus and applicable instrumentation for gathering test data, executing a matrix of tests, the method associated with each element of the matrix comprising the steps of filling one set of automobile tires with one set of rock aggregate resulting in a filled tire, placing the filled tire on the shake table, placing an axial load from the set of axial loads on the filled tire, setting the applicable instrumentation for gathering test data, applying the collection of vibrations to the filled tire and its axial load through the shake table, gathering a collection of test data based on the applicable instrumentation's response to the collection of vibrations applied to the shake table, analyzing a force-displacement plot based on the collection of test data resulting in an analysis of test data, selecting a filled tire system which best protects a habitable structure and its occupants against earthquake damage based on the analysis of test data.

8. The method of claim 7, wherein the step of analyzing a force-displacement plot based on the collection of test data resulting in an analysis of test data, includes an additional step of analyzing a stiffness coefficient based on the force-displacement plot resulting in the analysis of test data.

9. The method of claim 8, wherein the step of analyzing a stiffness coefficient based on the force-displacement plot resulting in the analysis of test data, includes and additional step of analyzing an apparent natural period of the filled tire and its axial load based on the stiffness coefficient resulting in the analysis of test data.

10. The method of claim 7, wherein the step of analyzing a force-displacement plot based on the collection of test data resulting in the analysis of test data, includes the additional steps of analyzing a hysteresis loop effect based on the force-displacement plot, and determining an effectiveness of dissipating energy by the filled tire based on the hysteresis loop effect resulting in the analysis of test data.

11. The method of claim 7, wherein the step of analyzing a force-displacement plot based on the collection of test data resulting in the analysis of test data, includes the step of analyzing a transmissibility plot based on the collection of test data resulting in the analysis of test data.

12. The method of claim 7, wherein the step of analyzing a force-displacement plot based on the collection of test data resulting in an analysis of test data, includes the step of analyzing a reduction in transmitted acceleration based on the collection of test data resulting in the analysis of test data.

13. An apparatus to protect a habitable structure and its occupants against earthquake damage, the apparatus comprising:

a habitable structure having a design and a resulting footprint pattern, a total weight and a distribution of weight, and a plurality of automobile tires filled with a collection of ¾ inch rock aggregate and having an axial load bearing per tire between 2,000 and 3,400 pounds per tire when filled with the collection of ¾ inch rock aggregate, generally placed individually and horizontally below the footprint pattern of the habitable structure at locations in accordance with the distribution of weight of the habitable structure such that the axial load on each tire is between 2,000 and 3,400 pounds per tire and in numbers sufficient to accommodate the total weight of the habitable structure, wherein the automobile tires are first positioned, filled with the collection of ¾ inch rock aggregate and then the habitable structure is positioned on top of the plurality of automobile tires.

14. The apparatus of claim 13, wherein the collection of ¾ inch rock aggregate comprises hard rock aggregate.

15. The apparatus of claim 13, wherein the collection of ¾ inch rock aggregate comprises crushed granite rock.

16. The apparatus of claim 13, wherein the collection of ¾ inch rock aggregate comprises crushed hard river rock.

17. The apparatus of claim 13, wherein the collection of ¾ inch rock aggregate comprises ¾ inch crushed rock aggregate.

18. The apparatus of claim 13, wherein the automobile tires are comprised of recycled automobile tires.

* * * * *